US012667876B2

(12) United States Patent
Ma et al.

(10) Patent No.: US 12,667,876 B2
(45) Date of Patent: Jun. 30, 2026

(54) ELECTRO-PLASTIC SHAPE CONTROL ROLLER SYSTEM BASED ON TRANSVERSE PARTITIONING AND INDEPENDENT CONTROL

(71) Applicant: Taiyuan University of Technology, Taiyuan (CN)

(72) Inventors: Xiaobao Ma, Taiyuan (CN); Tao Wang, Taiyuan (CN); Zhongkai Ren, Taiyuan (CN); Peng Chen, Taiyuan (CN); Xiao Liu, Taiyuan (CN); Xiaobin Fu, Taiyuan (CN); Shengyan Fu, Taiyuan (CN); Tao Wang, Taiyuan (CN); Han Guo, Taiyuan (CN)

(73) Assignee: Taiyuan University of Technology, Taiyuan (CN)

( * ) Notice: Subject to any disclaimer, the term of this patent is extended or adjusted under 35 U.S.C. 154(b) by 0 days.

(21) Appl. No.: 19/021,200

(22) Filed: Jan. 15, 2025

(65) Prior Publication Data

US 2026/0097426 A1 Apr. 9, 2026

(30) Foreign Application Priority Data

Oct. 8, 2024 (CN) ..... 202411394662.1

(51) Int. Cl.

| | |
|---|---|
| ***B21B 37/28*** | (2006.01) |
| ***B21B 27/02*** | (2006.01) |
| ***B21B 37/74*** | (2006.01) |

(52) U.S. Cl.

CPC ..... *B21B 37/28* (2013.01); *B21B 27/028* (2013.01); *B21B 37/74* (2013.01)

(58) Field of Classification Search

CPC ..... B21B 37/28; B21B 37/74; B21B 27/028

See application file for complete search history.

(56) References Cited

FOREIGN PATENT DOCUMENTS

| | | | | |
|---|---|---|---|---|
| JP | 0615319 A | * | 1/1994 | ..... B21B 27/06 |
| JP | 10192915 A | * | 7/1998 | ..... B21B 1/22 |

OTHER PUBLICATIONS

Machine Translation of JPH 06-15319 A (Year: 1994).*
Machine Translation of JPH 10-192915 A (Year: 1998).*

* cited by examiner

*Primary Examiner* — Christopher J. Besler
(74) *Attorney, Agent, or Firm* — Bayramoglu Law Offices LLC

(57) ABSTRACT

An electro-plastic shape control roller system based on transverse partitioning and independent control is provided. The electro-plastic shape control roller system includes a shape control roller mandrel, conductive copper rings, insulating ceramic rings, a shock-absorbing rubber sleeve, an insulating ceramic roller sleeve, and conductive rotary joints, etc. This system constructs a transversely partitioned electro-plastic shape control roller by alternately arranging the conductive copper rings and the insulating ceramic rings. During operation, a strip is wrapped at a certain angle above the electro-plastic shape control roller to ensure a tight contact between the strip and the conductive copper rings. According to the principle of minimum resistance in the conductive copper ring-strip-adjacent conductive copper ring pattern, the electro-plastic shape control roller system controls the on/off of each set of independent conductive copper rings through the external control circuit.

6 Claims, 6 Drawing Sheets

ELECTRO-PLASTIC SHAPE CONTROL ROLLER SYSTEM BASED ON TRANSVERSE PARTITIONING AND INDEPENDENT CONTROL

CROSS-REFERENCE TO THE RELATED APPLICATIONS

This application is based upon and claims priority to Chinese Patent Application No. 202411394662.1, filed on Oct. 8, 2024, the entire contents of which are incorporated herein by reference.

TECHNICAL FIELD

The present disclosure belongs to the field of plate and strip rolling equipment, and particularly relates to an electro-plastic shape control roller system based on transverse partitioning and independent control.

BACKGROUND

Shape is an important indicator of strip quality, and flatness control is an important aspect of improving strip shape quality. Poor local shape of a strip is essentially caused by excessive rolling pressure per unit width at the corresponding position of the rolling deformation zone, which results in increased longitudinal extension of the strip and ultimately causes buckling instability and wave formation.

Traditional shape control methods for cold rolling mainly include roller bending force, intermediate roller shifting, roller tilting, segmented cooling, and high-tension rolling, etc. The shape control effects of the roller bending force and roller shifting methods are mainly reflected at edges. The roller tilting method is mainly used to control the wedge shape. The segmented cooling method is mainly used to control high-order wave shapes, and it belongs to an approximately steady state control process, with poor real-time performance. The high-tension method can reduce the rolling force, but it has poor local shape control performance. Therefore, for a certain rolling mill structure, the control range of conventional shape control methods is certain, and their range of action in the width direction of the plate or strip is limited. With the development of plate rolling towards ultra-thin, extremely hard, extremely wide, and center-to-edge thinning control, complex high-order waves and coupling of flatness and cross-sectional profile control are prone to occur in the production process. Therefore, there is an urgent need to develop a new shape control method.

The above traditional shape control methods mainly adjust the rolling pressure in the deformation zone of the strip by changing the transverse stiffness and longitudinal tensile stress distribution of the roller gap. In fact, in addition to the transverse distribution of the roller gap and the tensile stress in the front-to-rear direction, the factors affecting the rolling force in the deformation zone also include the plastic characteristic parameters of the strip. By changing the yield stress of the strip in the rolling deformation zone and altering the formability of the material, the distribution of the rolling pressure can be changed, thereby achieving shape and quality control. In recent years, the theory and technology of electro-plasticity have developed rapidly. However, currently, traditional current loading devices cannot achieve precise and active control of local electro-plasticity along the width direction of the strip, and there is a lack of a clear and advanced electrical control system.

SUMMARY

To address the shortcomings and deficiencies of prior art, the present disclosure provides an electro-plastic shape control roller system based on transverse partitioning and independent control. The present disclosure solves the problems that traditional current loading devices cannot achieve precise and active control of local electro-plasticity along the width direction of the strip and there is a lack of an electrical control system.

In order to achieve the objective of the present disclosure, the present disclosure provides an electro-plastic shape control roller system based on transverse partitioning and independent control, including a shape control roller mandrel, where two ends of the shape control roller mandrel are respectively inserted into bearing seats for fixation; a bearing is provided between each of the two ends of the shape control roller mandrel and the bearing seat; conductive rotary joints are respectively fitted on outer walls of the two ends of the shape control roller mandrel, and multiple conductive copper rings are fitted on an outer wall of a middle of the shape control roller mandrel; insulating ceramic rings are arranged between adjacent conductive copper rings to isolate the conductive copper rings; multiple channels are provided inside the shape control roller mandrel; the channels each are provided therein with an insulated wire; the insulated wire includes one end connected to an inner wall of the conductive copper ring and the other end connected to the conductive rotary joint for current transmission; the conductive rotary joints are connected to a main circuit and a control circuit and configured to control on/off of different conductive copper rings.

As a further improvement of the above solution, an insulating ceramic roller sleeve is provided between the outer wall of the shape control roller mandrel and inner walls of the conductive copper rings and the insulating ceramic rings to achieve insulation and heat protection between the shape control roller mandrel and the conductive copper rings.

As a further improvement of the above solution, a shock-absorbing rubber sleeve is provided between the outer wall of the shape control roller mandrel and an inner wall of the insulating ceramic roller sleeve to achieve shock absorption during movement of the shape control roller mandrel, the conductive copper rings, and the insulating ceramic rings.

As a further improvement of the above solution, a key is provided to achieve position limiting between an outer wall of the shock-absorbing rubber sleeve and the inner wall of the insulating ceramic roller sleeve.

As a further improvement of the above solution, the main circuit includes a first power supply, a first multi-way contactor, a second multi-way contactor, and a multi-way thermal relay heating coil; a positive terminal of the first power supply is connected to one end of the first multi-way contactor, and the other end of the first multi-way contactor is connected to the conductive rotary joint at one end of the shape control roller mandrel; a – terminal of the first power supply is connected to one end of the multi-way thermal relay heating coil, and the other end of the multi-way thermal relay heating coil is connected to one end of the second multi-way contactor; the other end of the second multi-way contactor is connected to the conductive rotary joint at the other end of the shape control roller mandrel; and the conductive rotary joints at the two ends of the shape control roller mandrel are connected to corresponding conductive copper rings through the insulated wires.

As a further improvement of the above solution, in the main circuit, a line connecting the positive terminal of the first power supply to the first multi-way contactor is provided with a multi-way fuse for protecting normal operation of the main circuit.

As a further improvement of the above solution, the control circuit includes a second power supply, a programmable logic controller (PLC), a multi-way contactor control coil, a multi-way thermal relay, an output circuit fuse, and an input master button; pins X000 to X002 of the PLC are respectively connected to corresponding ends of SB1 to SB3 of the input master button; the other ends of SB1 to SB3 of the input master button are connected to a pin COM of the PLC; a pin COM0 of the PLC is connected to one end of the output circuit fuse, and the other end of the output circuit fuse is connected to a positive terminal of the second power supply; pins Y000 to Y00*n* of the PLC are respectively connected to corresponding ends of $KM_1$ to $KM_n$ of the multi-way contactor control coil; pins Y00($n$+1) to Y00(2*n*) of the PLC are respectively connected to corresponding ends of $KM_{1a}$ to $KM_{na}$ of the multi-way contactor control coil; the other ends of $KM_{1a}$ to $KM_{na}$ of the multi-way contactor control coil are respectively connected to corresponding ends of $KH_{1a}$ to $KH_{na}$ of the multi-way thermal relay; and the other ends of $KM_1$ to $KM_n$ of the multi-way contactor control coil and the other ends of $KH_{1a}$ to $KH_{na}$ of the multi-way thermal relay are connected to a negative terminal of the second power supply.

As a further improvement of the above solution, lower sides of the conductive copper rings and the insulating ceramic rings are immersed into an oil medium cooler for cooling.

As a further improvement of the above solution, a maximum width of the conductive copper ring and a maximum width of the insulating ceramic ring are one eighth of a width of a strip.

As a further improvement of the above solution, the first power supply is a high-frequency pulse power supply.

The present disclosure has following beneficial effects:

Compared with the prior art, the present disclosure provides an electro-plastic shape control roller system based on transverse partitioning and independent control. In the present disclosure, the conductive copper rings and the insulating ceramic rings are arranged at intervals, and the control circuit constructs partitioned electric heating zones in the transverse direction of the strip to change the local plastic state of the strip, thereby affecting the rolling pressure distribution in the deformation zones and ultimately achieving the goal of strip shape control. The present disclosure makes up for the shortcomings of existing shape control methods, improves the control ability of the rolling mill for high-order complex shapes, and provides technical support for the rolling of ultra-wide, high-strength, ultra-thin, and high-quality plate and strip materials. Meanwhile, due to the microscopic convexity distribution of the cross-section of the strip, this system uses segmented conductive copper rings as the basic structure of the integrated roller body, ensuring system stiffness and applying certain pressure to the strip, thereby ensuring close contact between the conductive copper rings and the strip during operation. In addition, this system can be used as a winding guide roller, tension gauge roller, and inter-rack loop roller. The present disclosure features a simple structure, reliable electrical control, and fast electric heating speed, meeting the online rapid shape control requirements and the online electro-plasticity requirements for high-strength difficult-to-deform metals and near-isothermal rolled strips with narrow temperature windows.

In summary, this system constructs a transversely partitioned electro-plastic shape control roller by alternately arranging the conductive copper rings and the insulating ceramic rings. During operation, the strip is wrapped at a certain angle above the electro-plastic shape control roller to ensure a tight contact between the strip and the conductive copper rings. According to the principle of minimum resistance in the conductive copper ring-strip-adjacent conductive copper ring pattern, the present disclosure controls the on/off of each set of independent conductive copper rings through the external control circuit. The present disclosure achieves electric heating at different positions along the width direction of the strip, and changes the plastic state of the strip entering the rolling deformation zone. In this way, the present disclosure affects the rolling pressure in the deformation zone, ultimately achieving the goal of online shape control.

Figure 1:
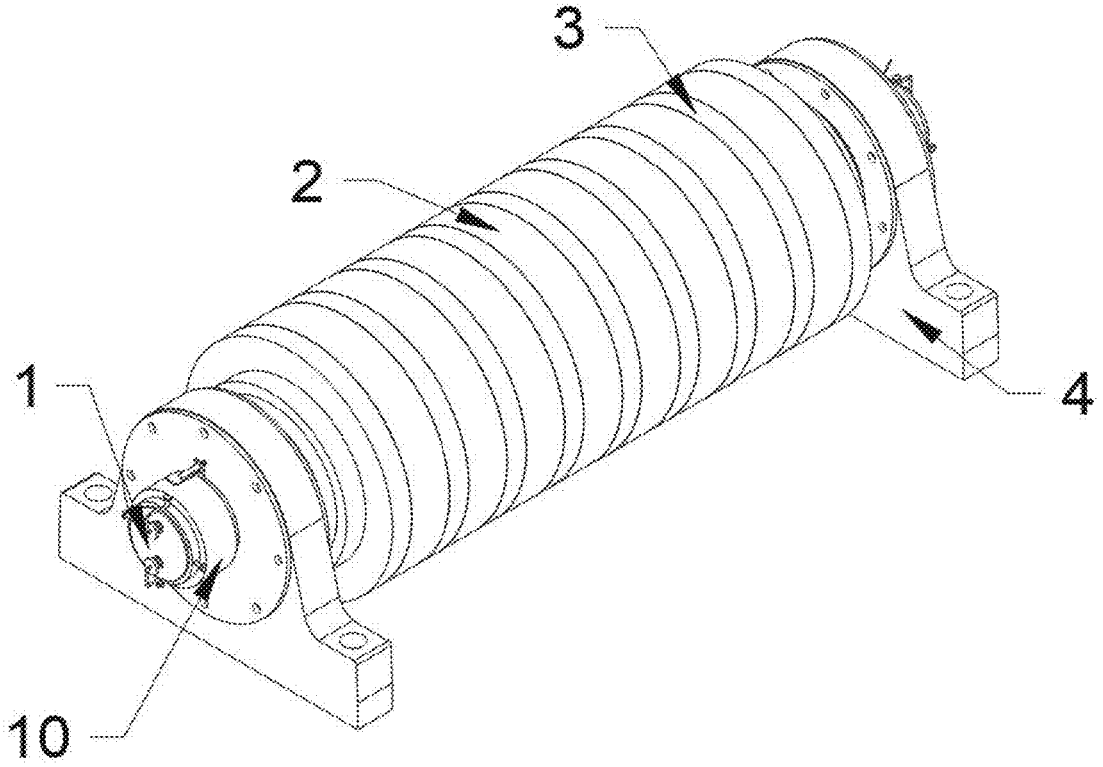
FIG. 1 is a schematic diagram according to the present disclosure.

Reference Numerals: 1. shape control roller mandrel; 2. conductive copper ring; 3. insulating ceramic ring; 4. bearing seat; 5. insulated wire; 6. shock-absorbing rubber sleeve; 7. insulating ceramic roller sleeve; 8. first power supply; 8-1. second power supply; 9. key; 10. conductive rotary joint; 11. channel; 701. multi-way contactor; 702. multi-way fuse; 703. multi-way contactor; 704. multi-way thermal relay heating coil; 901. PLC; 902. multi-way contactor control coil; 903. multi-way thermal relay; 904. output circuit fuse; and 905. input master button.

DETAILED DESCRIPTION OF THE EMBODIMENTS

The specific implementations of the present disclosure are described in further detail below with reference to the drawings.

Figure 2:
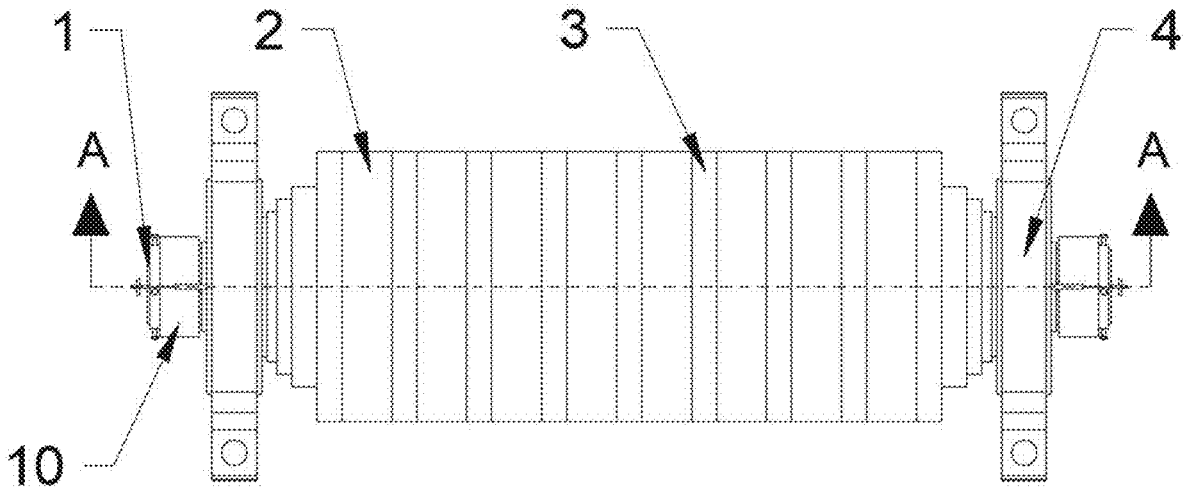
FIG. 2 is a top view according to the present disclosure.
Figure 3:
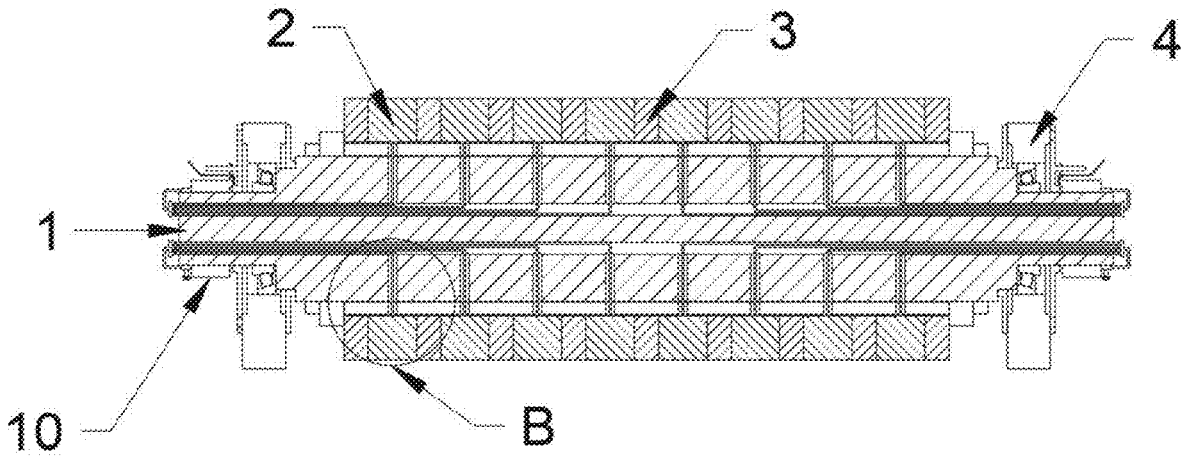
FIG. 3 is a section view taken along line A-A shown in FIG. 2.
Figure 4:
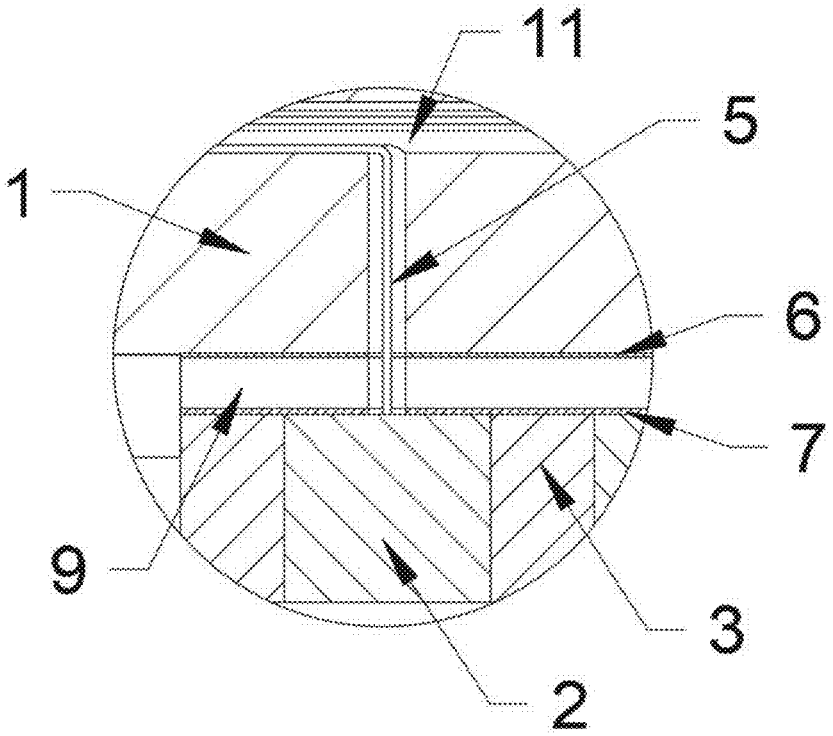
FIG. 4 is an enlarged view of circle B shown in FIG. 3.
Figure 5:
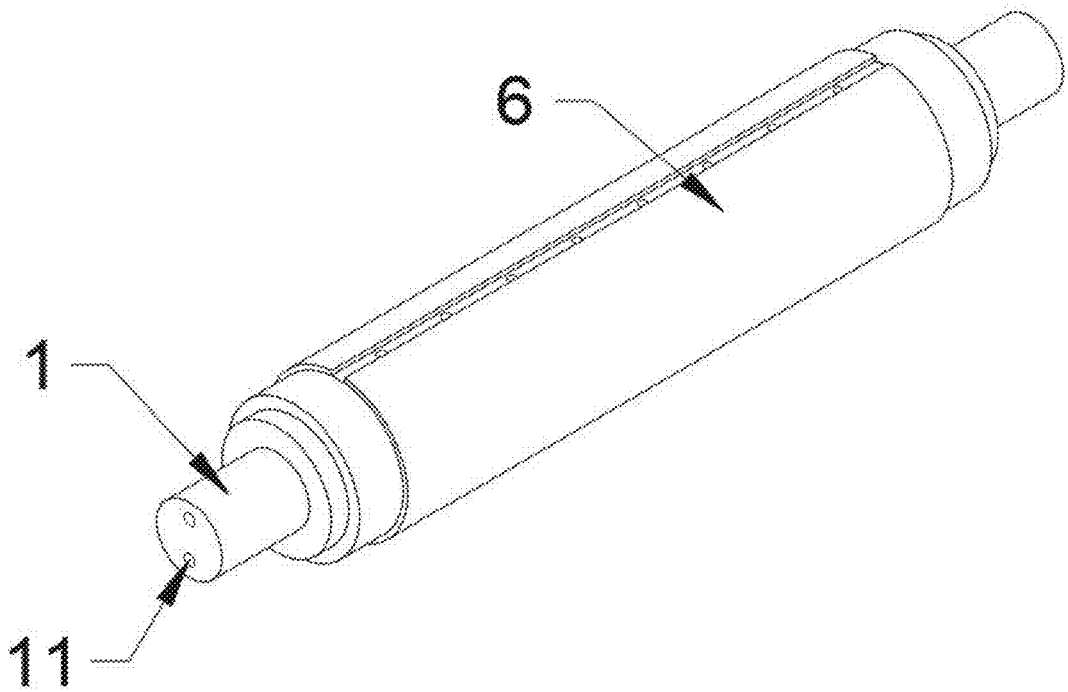
FIG. 5 is a structural diagram of a shape control roller mandrel and a shock-absorbing rubber sleeve according to the present disclosure.
Figure 6:
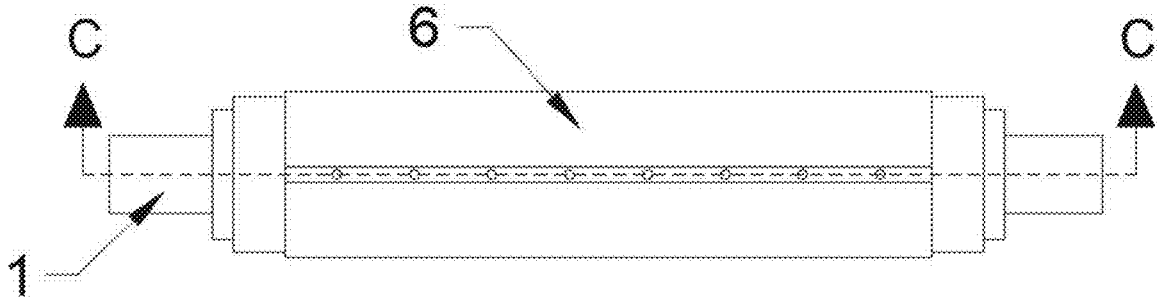
FIG. 6 is a top view of the shape control roller mandrel and the shock-absorbing rubber sleeve according to the present disclosure.
Figure 7:
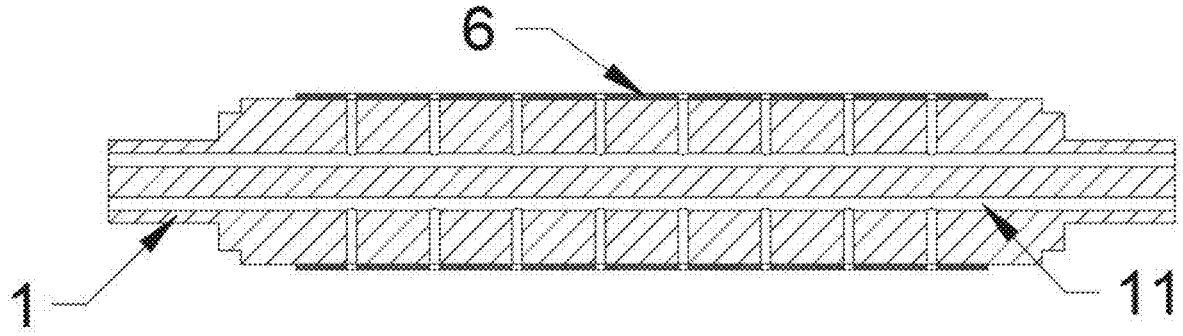
FIG. 7 is a section view taken along line C-C shown in FIG. 6.
Figure 8:
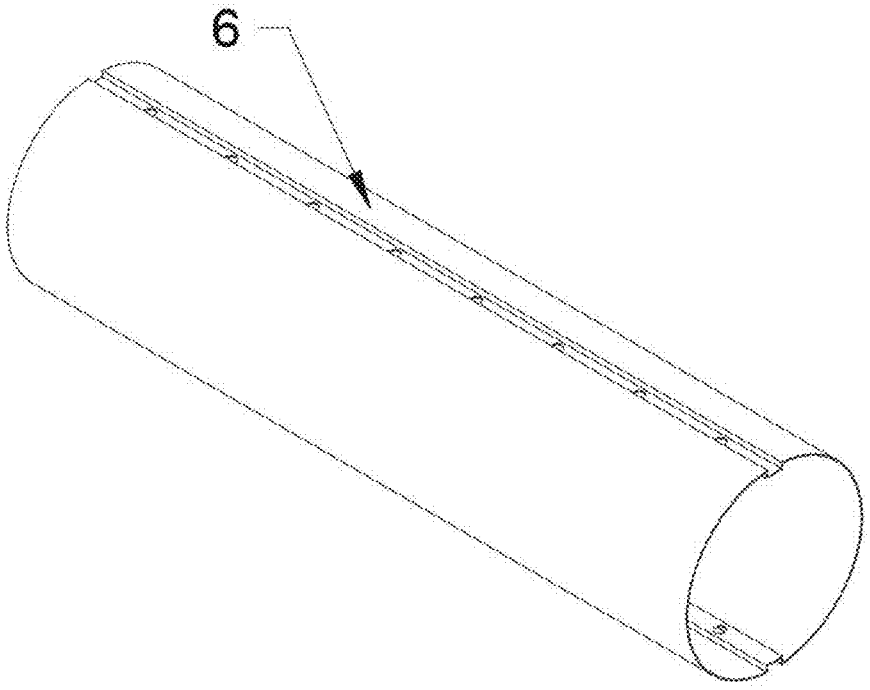
FIG. 8 is a schematic diagram of the shock-absorbing rubber sleeve according to the present disclosure.
Figure 9:
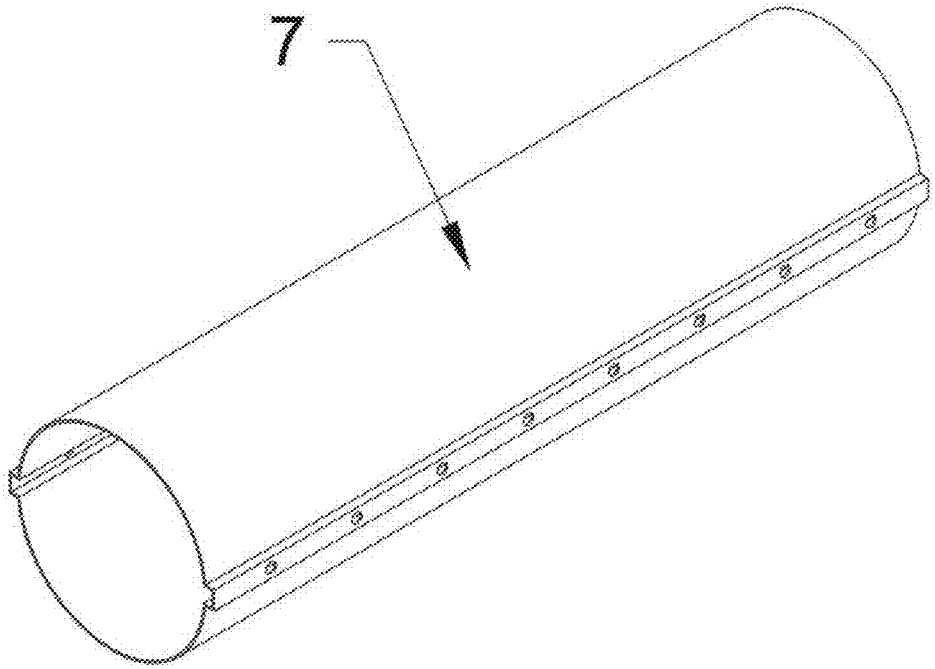
FIG. 9 is a schematic diagram of an insulating ceramic roller sleeve according to the present disclosure.
Figure 10:
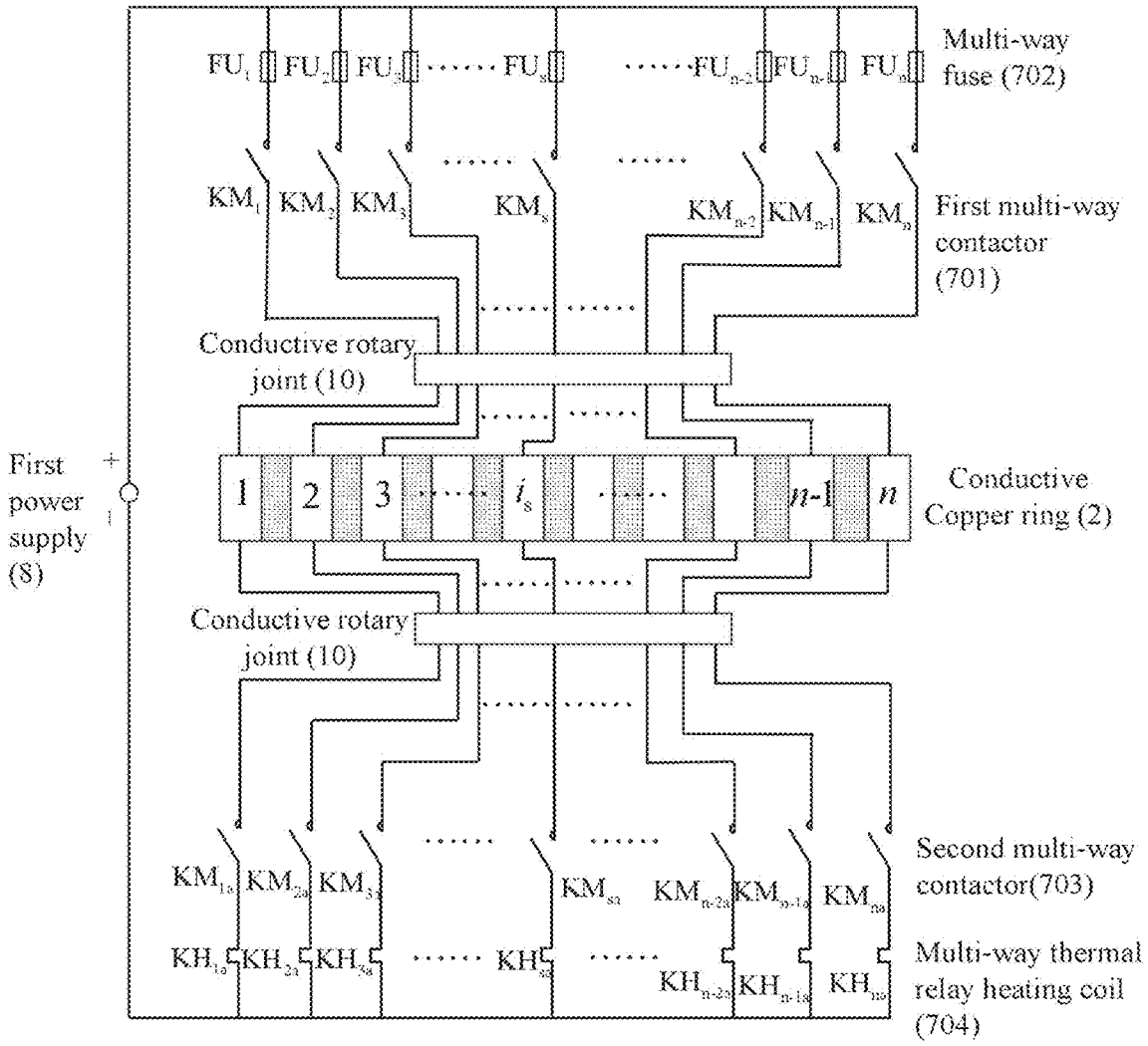
FIG. 10 is a line and hardware connection diagram of a main circuit according to the present disclosure.
Figure 11:
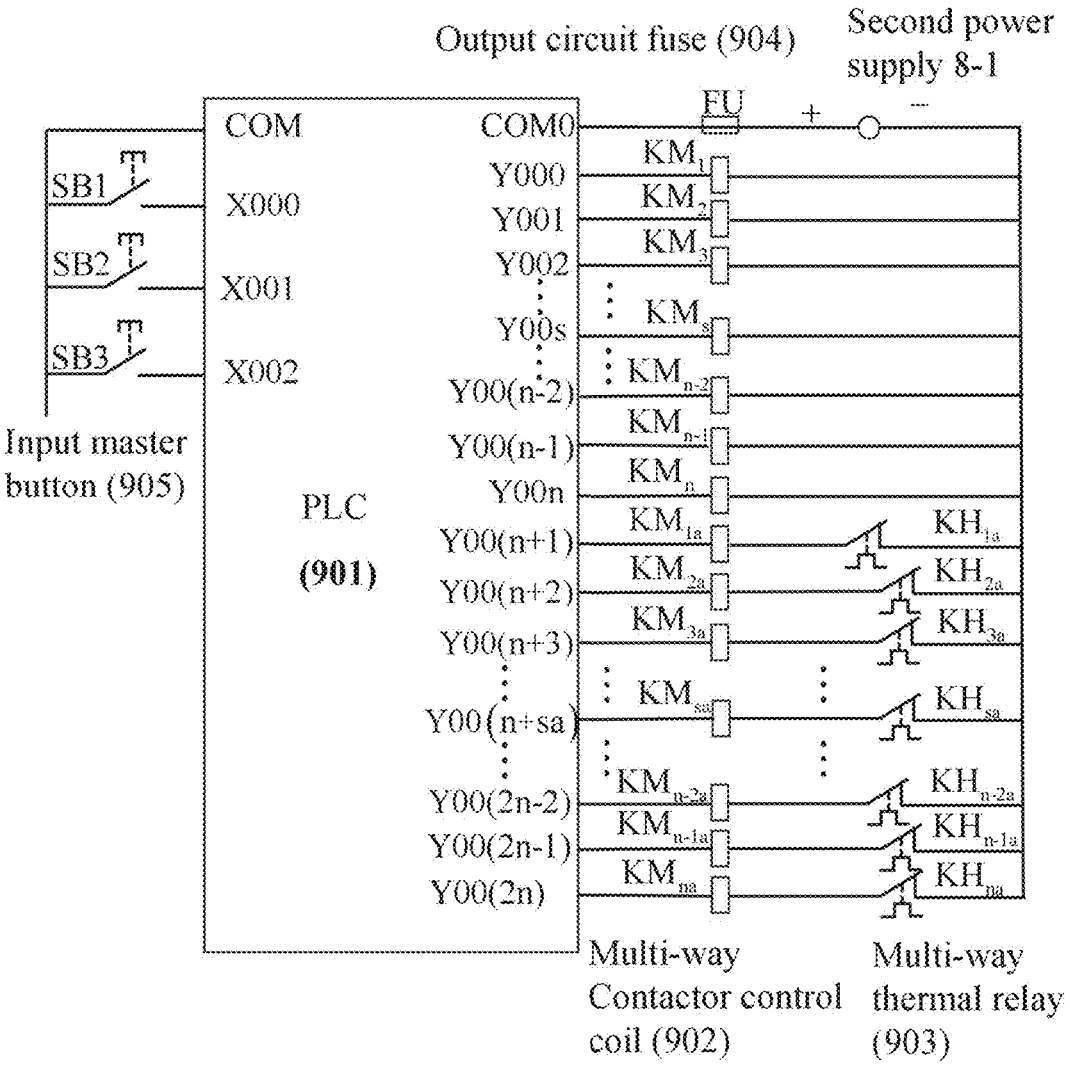
FIG. 11 is a line and hardware connection diagram of a control circuit according to the present disclosure.

According to FIGS. 1 to 11, the present disclosure provides an electro-plastic shape control roller system based on transverse partitioning and independent control, including shape control roller mandrel 1. Two ends of the shape control roller mandrel 1 are respectively inserted into bearing seats 4 for fixation. A bearing is provided between each of the two ends of the shape control roller mandrel 1 and the bearing seat 4 to improve rotation smoothness of the shape control roller mandrel 1. Conductive rotary joints 10 are respectively fitted on outer walls of the two ends of the shape control roller mandrel 1, and multiple conductive copper rings 2 are fitted on an outer wall of a middle of the shape control roller mandrel 1. Insulating ceramic rings 3 are arranged between adjacent conductive copper rings 2 to isolate the conductive copper rings 2. A maximum width of the conductive copper ring 2 and a maximum width of the insulating ceramic ring 3 are one eighth of a width of a strip. Multiple channels 11 are provided inside the shape control roller mandrel 1. The channels 11 each are provided therein with insulated wire 5. The insulated wire 5 includes one end connected to an inner wall of the conductive copper ring 2 and the other end connected to the conductive rotary joint 10 for current transmission. The conductive rotary joints 10 are connected to a main circuit and a control circuit and configured to control on/off of different conductive copper rings 2. Lower sides of the conductive copper rings 2 and the insulating ceramic rings 3 are immersed into an oil medium cooler for cooling.

Insulating ceramic roller sleeve 7 is provided between the outer wall of the shape control roller mandrel 1 and inner walls of the conductive copper rings 2 and the insulating ceramic rings 3 to achieve insulation and heat protection between the shape control roller mandrel 1 and the conductive copper rings 2. Shock-absorbing rubber sleeve 6 is provided between the outer wall of the shape control roller mandrel 1 and an inner wall of the insulating ceramic roller sleeve 7 to achieve shock absorption during movement of the shape control roller mandrel 1, the conductive copper rings 2, and the insulating ceramic rings 3. Key 9 is provided to achieve position limiting between an outer wall of the shock-absorbing rubber sleeve 6 and the inner wall of the insulating ceramic roller sleeve 7.

The main circuit includes first power supply 8, first multi-way contactor 701, second multi-way contactor 703, and multi-way thermal relay heating coil 704. A positive terminal of the first power supply 8 is connected to one end of the first multi-way contactor 701, and the other end of the first multi-way contactor 701 is connected to the conductive rotary joint 10 at one end of the shape control roller mandrel 1. A – terminal of the first power supply 8 is connected to one end of the multi-way thermal relay heating coil 704, and the other end of the multi-way thermal relay heating coil 704 is connected to one end of the second multi-way contactor 703. The other end of the second multi-way contactor 703 is connected to the conductive rotary joint 10 at the other end of the shape control roller mandrel 1. The conductive rotary joints 10 at the two ends of the shape control roller mandrel 1 are connected to corresponding conductive copper rings 2 through the insulated wires 5. In the main circuit, a line connecting the positive terminal of the first power supply 8 to the first multi-way contactor 701 is provided with multi-way fuse 702 for protecting normal operation of the main circuit. The first power supply 8 is a high-frequency pulse power supply, with controllable parameters including output voltage, output current, pulse frequency, pulse width, and duty cycle. During operation, the conductive rotary joint 10 at one end of the shape control roller mandrel 1 is connected to the positive terminal of the first power supply 8 through a wire, and the conductive rotary joint 10 at the other end is connected to the negative terminal of the first power supply 8 through a wire. A number of branches connecting the conductive rotary joints 10 to the positive and – terminals of the first power supply 8 is equal to a number of the conductive copper rings 6 in the middle of the shape control roller mandrel 1, and each branch is insulated from each other. During operation, the control circuit ensures that two ways of the same conductive copper ring 6 connected to the positive and – terminals of the first power supply 8 are not connected simultaneously.

The control circuit includes second power supply 8-1, programmable logic controller (PLC) 901, multi-way contactor control coil 902, multi-way thermal relay 903, output circuit fuse 904, and input master button 905. Pins X000 to X002 of the PLC 901 are respectively connected to corresponding ends of SB1 to SB3 of the input master button 905. The other ends of SB1 to SB3 of the input master button 905 are connected to pin COM of the PLC 901. Pin COM0 of the PLC 901 is connected to one end of the output circuit fuse 904, and the other end of the output circuit fuse 904 is connected to a positive terminal of the second power supply 8-1. Pins Y000 to Y00*n* of the PLC 901 are respectively connected to corresponding ends of $KM_1$ to $KM_n$ of the multi-way contactor control coil 902. Pins Y00($n$+1) to Y00(2*n*) of the PLC 901 are respectively connected to corresponding ends of $KM_{1a}$ to $KM_{na}$ of the multi-way contactor control coil 902. The other ends of $KM_{1a}$ to $KM_{na}$ of the multi-way contactor control coil 902 are respectively connected to corresponding ends of $KH_{1a}$ to $KH_{na}$ of the multi-way thermal relay 903. The other ends of $KM_1$ to $KM_n$ of the multi-way contactor control coil 902 and the other ends of $KH_{1a}$ to $KH_{na}$ of the multi-way thermal relay 903 are connected to a negative terminal of the second power supply 8-1. During operation, the PLC 901 logically controls the on/off of the multi-way contactor control coil 902, and the first contactor 701 and the second contactor 703 control the on/off between the first power supply 8 and the circuit of each conductive copper ring 2, ultimately achieving electro-plastic control of the strip. The multi-way thermal relay heating coil 704 of the main circuit affects the on/off of the multi-way thermal relay 903 in the control circuit, thereby controlling the temperature of the circuit of each conductive copper ring 2. If the temperature is too high, turn-off is enabled to prevent the circuit and components from burning out due to long-term high temperature in the circuit of the conductive copper ring 2. The multi-way fuse 702 in the main circuit prevents short circuits or severe overloads in the circuit, and prevents the instantaneous overcurrent of the circuit of the conductive copper ring 2 from causing the circuit and components to burn out. The PLC 901 ensures the connection between the conductive rotary joint 10 connected to any conductive copper ring 2 and the first power supply 8.

Axial widths of the conductive copper rings 2 and the insulating ceramic rings 3 arranged at intervals are uniformly or unevenly set, but the maximum width is one eighth of the width of the main rolled strip designed for the production line, to meet the shape control requirements for more than 4 passes.

Each conductive copper ring 2 can be individually controlled for power on/off, and the first power supply 8 can perform real-time control of electrical parameters. During operation, the strip is wrapped at a certain angle around surfaces of the conductive copper rings 2 that are transversely partitioned and independently controlled, ensuring good contact between the strip and the surfaces of the conductive copper rings 2.

The foregoing embodiments are not limited to the technical solutions of the embodiments, and the embodiments may be combined with each other to form new embodiments. The foregoing embodiments are merely intended to illustrate the technical solutions of the present disclosure, rather than limiting the present disclosure. Any modification or equivalent replacement without departing from the spirit and scope of the present disclosure shall fall within the scope of the technical solutions of the present disclosure.

What is claimed is:

1. An electro-plastic shape control roller system based on transverse partitioning and independent control, comprising a shape control roller mandrel, wherein two ends of the shape control roller mandrel are respectively inserted into bearing seats for fixation;

a bearing is provided between each of the two ends of the shape control roller mandrel and a respective one of the bearing seats;

conductive rotary joints are respectively fitted on outer walls of the two ends of the shape control roller mandrel, and a plurality of conductive copper rings are fitted on an outer wall of a middle of the shape control roller mandrel;

insulating ceramic rings are arranged between adjacent ones of the plurality of conductive copper rings to isolate the plurality of conductive copper rings;

a plurality of channels are provided inside the shape control roller mandrel;

the plurality of channels each are provided therein with an insulated wire;

the insulated wire comprises a first end connected to an inner wall of a respective one of the plurality of conductive copper rings and a second end connected to a respective one of the conductive rotary joints for current transmission;

the conductive rotary joints are connected to a main circuit and a control circuit and configured to control on/off of different conductive copper rings;

the main circuit comprises a first power supply, a first multi-way contactor, a second multi-way contactor, and a multi-way thermal relay heating coil;

a positive terminal of the first power supply is connected to a first end of the first multi-way contactor, and a second end of the first multi-way contactor is connected to the conductive rotary joint at the first end of the shape control roller mandrel;

a negative terminal of the first power supply is connected to a first end of the multi-way thermal relay heating coil, and a second end of the multi-way thermal relay heating coil is connected to a first end of the second multi-way contactor;

a second end of the second multi-way contactor is connected to the conductive rotary joint at the second end of the shape control roller mandrel;

the conductive rotary joints at the two ends of the shape control roller mandrel are connected to corresponding ones of the plurality of conductive copper rings through the insulated wires;

the control circuit comprises a second power supply, a programmable logic controller (PLC), a multi-way contactor control coil, a multi-way thermal relay, an output circuit fuse, and an input master button;

pins X000, X001, and X002 of the PLC are respectively connected to corresponding first ends of switches SB1, SB2, and SB3 of the input master button;

second ends of the switches SB1, SB2, and SB3 of the input master button are connected to a PLC pin COM;

a PLC pin COM0 is connected to a first end of the output circuit fuse, and a second end of the output circuit fuse is connected to a positive terminal of the second power supply;

a first plurality of PLC output pins are respectively connected to corresponding first ends of a first plurality of coils of the multi-way contactor control coil;

a second plurality of PLC output pins are respectively connected to corresponding first ends of a second plurality of coils of the multi-way contactor control coil;

second ends of the second plurality of coils of the multi-way contactor control coil are respectively connected to corresponding first ends of the multi-way thermal relay;

second ends of the first plurality of coils of the multi-way contactor control coil and corresponding second ends of the multi-way thermal relay are connected to a negative terminal of the second power supply;

an insulating ceramic roller sleeve is provided between the outer wall of the shape control roller mandrel and inner walls of the plurality of conductive copper rings and the insulating ceramic rings to achieve insulation and heat protection between the shape control roller mandrel and the plurality of conductive copper rings; and a shock-absorbing rubber sleeve is provided between the outer wall of the shape control roller mandrel and an inner wall of the insulating ceramic roller sleeve to achieve shock absorption during movement of the shape control roller mandrel, the plurality of conductive copper rings, and the insulating ceramic rings.

2. The electro-plastic shape control roller system based on the transverse partitioning and independent control according to claim 1, wherein a key is provided to achieve position limiting between an outer wall of the shock-absorbing rubber sleeve and the inner wall of the insulating ceramic roller sleeve.

3. The electro-plastic shape control roller system based on the transverse partitioning and independent control according to claim 1, wherein in the main circuit, a line connecting the positive terminal of the first power supply to the first multi-way contactor is provided with a multi-way fuse for protecting normal operation of the main circuit.

4. The electro-plastic shape control roller system based on the transverse partitioning and independent control according to claim 1, wherein the system further comprises an oil medium cooler, and lower sides of the plurality of conductive copper rings and the insulating ceramic rings are immersed into the oil medium cooler for cooling.

5. The electro-plastic shape control roller system based on the transverse partitioning and independent control according to claim 4, wherein a maximum width of the conductive copper ring and a maximum width of the insulating ceramic ring are one eighth of a width of a strip.

6. The electro-plastic shape control roller system based on the transverse partitioning and independent control according to claim 1, wherein the first power supply is a high-frequency pulse power supply.

* * * * *